US005806427A

United States Patent [19]

Niemiro et al.

[11] Patent Number: 5,806,427

[45] Date of Patent: Sep. 15, 1998

[54] PRINTING PRESS HAVING CARRIAGE MOUNTED INTERCHANGEABLE PLATE CYLINDERS

[75] Inventors: Thaddeus A. Niemiro, Lisle; Thomas W. Orzechowski, Orland Park, both of Ill.

[73] Assignee: Goss Graphic Systems, Inc., Westmont, Ill.

[21] Appl. No.: 920,942

[22] Filed: Aug. 29, 1997

[51] Int. Cl.[6] ..... B41F 5/18

[52] U.S. Cl. ..... 101/247; 101/477; 101/479

[58] Field of Search ..... 101/477, 479, 101/212, 216, 217, 218, 247, 351, 181, 182, 143

[56] References Cited

U.S. PATENT DOCUMENTS

| | | | |
|---|---|---|---|
| 1,414,107 | 4/1922 | Wood et al. . | |
| 1,549,869 | 8/1925 | Halliwell . | |
| 1,654,058 | 12/1927 | Smith . | |
| 2,460,504 | 2/1949 | Huebner | 101/479 |
| 2,790,384 | 4/1957 | Kaldschmidt | 101/216 |
| 3,424,084 | 1/1969 | Chambon | 101/247 |
| 3,470,816 | 10/1969 | Piecha et al. | 101/218 |
| 4,413,541 | 11/1983 | Biegar, III | 101/247 |
| 4,462,311 | 7/1984 | Armelin | 101/143 |
| 4,552,067 | 11/1985 | Gollinger . | |
| 4,697,516 | 10/1987 | Rombout . | |
| 4,788,912 | 12/1988 | Fischer . | |
| 4,798,137 | 1/1989 | Hermach et al. . | |
| 4,827,842 | 5/1989 | Theilacker et al. . | |
| 4,961,379 | 10/1990 | Gollinger et al. | 101/479 |
| 4,998,829 | 3/1991 | Greer | 101/247 |
| 5,022,251 | 6/1991 | Negrussi | 101/216 |
| 5,134,934 | 8/1982 | Knauer et al. | 101/143 |
| 5,528,986 | 6/1996 | Andersson | 101/479 |
| 5,692,442 | 12/1997 | LeAnna | 101/247 |
| 5,715,749 | 2/1998 | Miller | 101/477 |

*Primary Examiner*—Eugene H. Eickholt

*Attorney, Agent, or Firm*—Marshall, O'Toole, Gerstein, Murray & Borun

[57] ABSTRACT

A rotary offset printing press having a pair of carriage mounted interchangeable plate cylinders is disclosed. The carriage is slidably mounted to the press and reciprocates along a generally linear path. The pair of plate cylinders are rotatably mounted to the carriage, and each of the plate cylinders is selectively moveable into an operative position in contact with the blanket cylinder. Accordingly, while the press is operating using one of the plate cylinders, the other plate cylinder is idle, which permits the impression sleeve thereon to be removed and replaced without stopping the press. The plate cylinders, when in their respective operative positions, contact the blanket cylinder at the same point of tangency, thus simplifying registration.

27 Claims, 4 Drawing Sheets

PRINTING PRESS HAVING CARRIAGE MOUNTED INTERCHANGEABLE PLATE CYLINDERS

FIELD OF THE INVENTION

The present invention relates generally to a rotary offset printing press having a pair of carriage mounted plate cylinders, one of which is positioned to transfer images to a blanket cylinder while the other is idle. The carriage mounted plate cylinder arrangement allows the press operator to re-plate the idle plate cylinder while the press is running at full speed, and thus changeover can be effectuated very quickly.

BACKGROUND OF THE INVENTION

Rotary offset double-sided printing presses are generally well known in the art. On rotary presses, a web of paper passes through one or more printing units or couples, with each couple having a pair of blanket cylinders in contact with the opposite sides of the paper web. Each blanket cylinder is in contact with a plate cylinder which transfers images to the blanket cylinder for printing onto the web in a manner well known in the art. In order to change the printed material, the plate or impression sleeve on one or both of the plate cylinders must be separated from its adjacent blanket cylinder and changed.

Typically, when a rotary offset printing press is operated for short runs or when editorial changes must be made in newspaper production, the printing press is stopped, the plate cylinders are removed form the printing press, the impression sleeves on the plate cylinders are changed, the plate cylinders are re-installed in the printing press, and the machine is then re-started. Each time the press is started, stopped, and re-started a tremendous amount of paper is wasted as the machine slows to a stop and is subsequently brought back up to operating speed after the changeover has been completed. Moreover, a tremendous amount of valuable time is lost as the impression sleeves are changed and the ink settings are adjusted while the press sits idle.

Accordingly, there exists a need for a rotary offset printing press having interchangeable plate cylinders, each having a different impression sleeve, so that changeovers can be made quickly and efficiently without stopping and re-starting the printing press. There also exists a need for a printing press on which the impression sleeve on the inactive plate cylinder can be changed safely while the press is still operating using the other plate cylinder.

SUMMARY OF THE INVENTION

The present invention uses a pair of interchangeable plate cylinders mounted on a moveable carriage so that each plate cylinder can be selectively brought into contact with its adjacent blanket cylinder. The carriage is supported by linear bearings enabling the carriage to move back and forth along a generally linear path, thus enabling one of the plate cylinders to be brought into contact with the blanket cylinder while the other plate cylinder is shifted away from the blanket cylinder to an inoperative position. Thus, while one of the plate cylinders is in operation the other plate cylinder is idle, which permits the impression sleeve on the idle plate cylinder to be installed or replaced while the printing press is operating at full speed. Accordingly, downtime is greatly reduced. Furthermore, because the plate cylinders are paired and move in unison, only one of the plate cylinders can contact the blanket cylinder at a time, and consequently the plate cylinders never interfere with each other.

The present invention also incorporates a pair of retractable form or inking rollers which are thrown out of position prior to movement of the carriage and which permit generally linear movement of the carriage, thereby enabling each of the plate cylinders, when in their respective operative positions, to contact the blanket cylinder at the same point of tangency. Consequently, it is much easier to keep the plate cylinders in proper register, which is especially important in multi-color and verso-printing processes. Moreover, the linear travel of each plate cylinder away from the blanket cylinder is far enough that no axial movement (i.e. movement of the plate cylinder in a direction parallel to the axis of the blanket cylinder) is required.

Preferably, each of the plate cylinders are rotated by separate drive motors. When the idle cylinder has been plated up and is ready for use, the cylinder can be pre-driven to match the speed of the press, registered, and brought into contact with the blanket cylinder upon movement of the carriage. The other cylinder can then be stopped and re-sleeved in preparation for the next changeover. Ideally, the changeover process can take place very quickly, and changeover times being as short as five (5) seconds or less are contemplated. Thus, down time and wasted paper are effectively eliminated.

Accordingly, it is an object of this invention to provide a rotary offset printing press having interchangeable carriage mounted plate cylinders which virtually eliminate wasted paper and downtime.

Another object of this invention is to provide a rotary printing press having a pair of interchangeable plate cylinders and which is more cost effective for short printing runs and editorial zone changes than are prior art presses.

A further object of this invention is to provide a printing press having interchangeable plate cylinders that contact the blanket cylinder at the same point of tangency when in their respective operative positions.

A still further object of this invention is to provide a paired plate cylinder arrangement which eliminates the possibility of interference between the plate cylinders.

These and other objects of the invention will become readily apparent to those skilled in the art upon a reading of the following description with reference being had to the accompanying drawings.

DETAILED DESCRIPTION OF THE INVENTION

The embodiment herein described is not intended to be exhaustive and is not intended to limit the invention to the precise form disclosed. The embodiment has been chosen and described in order to explain the principles of the invention and its practical use so that others skilled in the art may follow its teachings.

Figure 1:
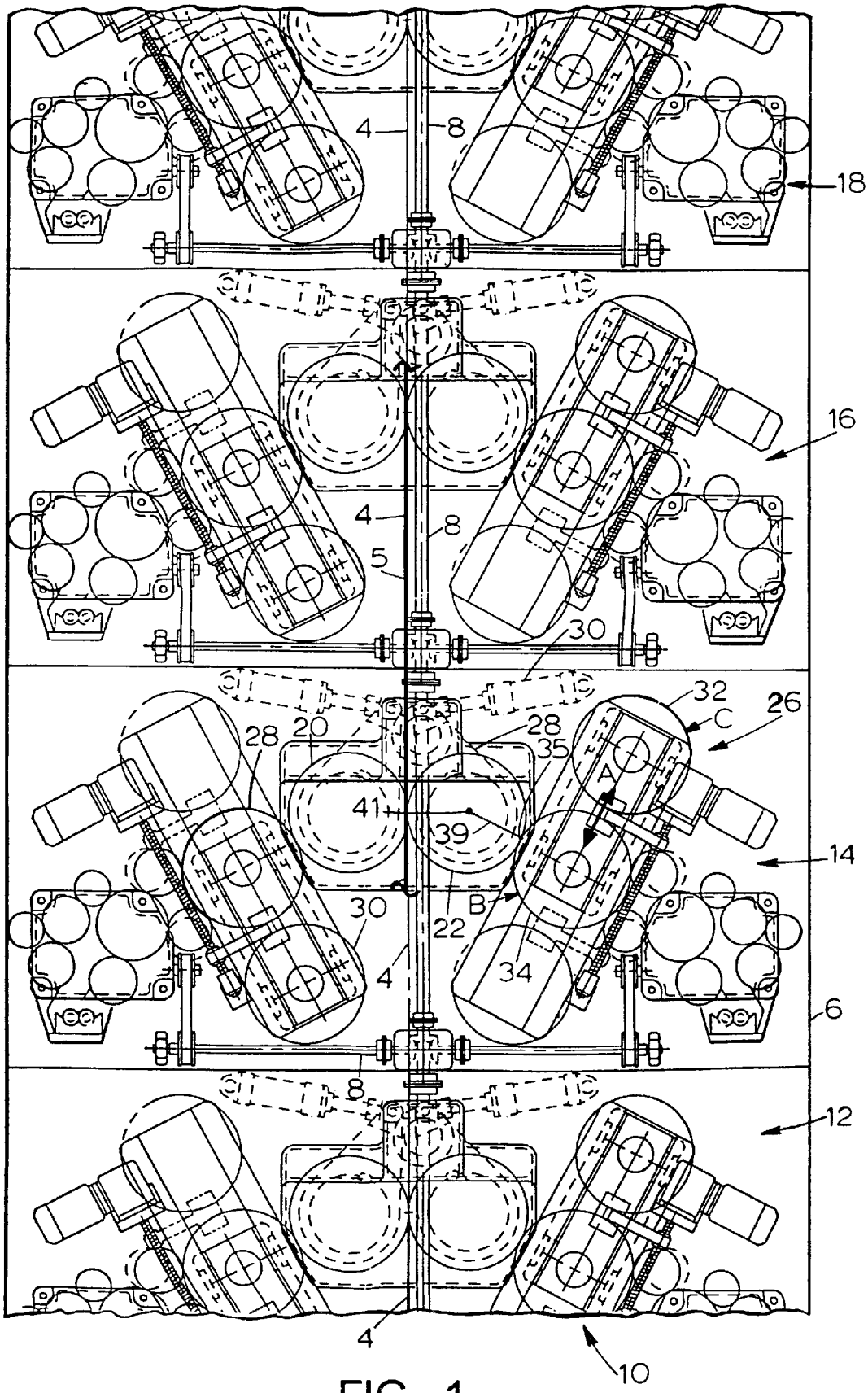
FIG. 1 is an elevational view of a rotary offset printing press incorporating the features of the present invention.

Referring now to the drawings, a rotary offset printing press incorporating the features of the present invention is generally referred to by the reference numeral 10. Press 10 includes a housing or frame 6 and a synchronized drive system 8 as is commonly employed in the industry for driving the rotatable components described below. As shown in FIG. 1, press 10 typically includes four printing units or couples 12, 14, 16 and 18 are arranged in progression such that a paper web or substrate 5 moves along a path 4 between the contact nip of each couple. Substrate 5 is typically a continuous web of paper as is well known in the art. In four color offset lithographic printing, the image to be printed on the substrate 5 is decomposed into four color "separations" which are combined to facilitate the printing of the final image. The four separations are comprised of the primary or black separation, and three secondary separations, typically cyan, magenta and yellow. Each of the printing couples 12, 14, 16, 18 applies one of the separations, with each separation being superimposed over the preceding separation(s) to form the final image, all of which is well known in the art.

Although FIG. 1 illustrates four printing couples 12, 14, 16, 18 arranged in progression, it will be understood that, except for the different color being applied, the structure, function and operation of each printing couple is the same. Accordingly, only printing couple 14 will be described in detail.

Figure 2:
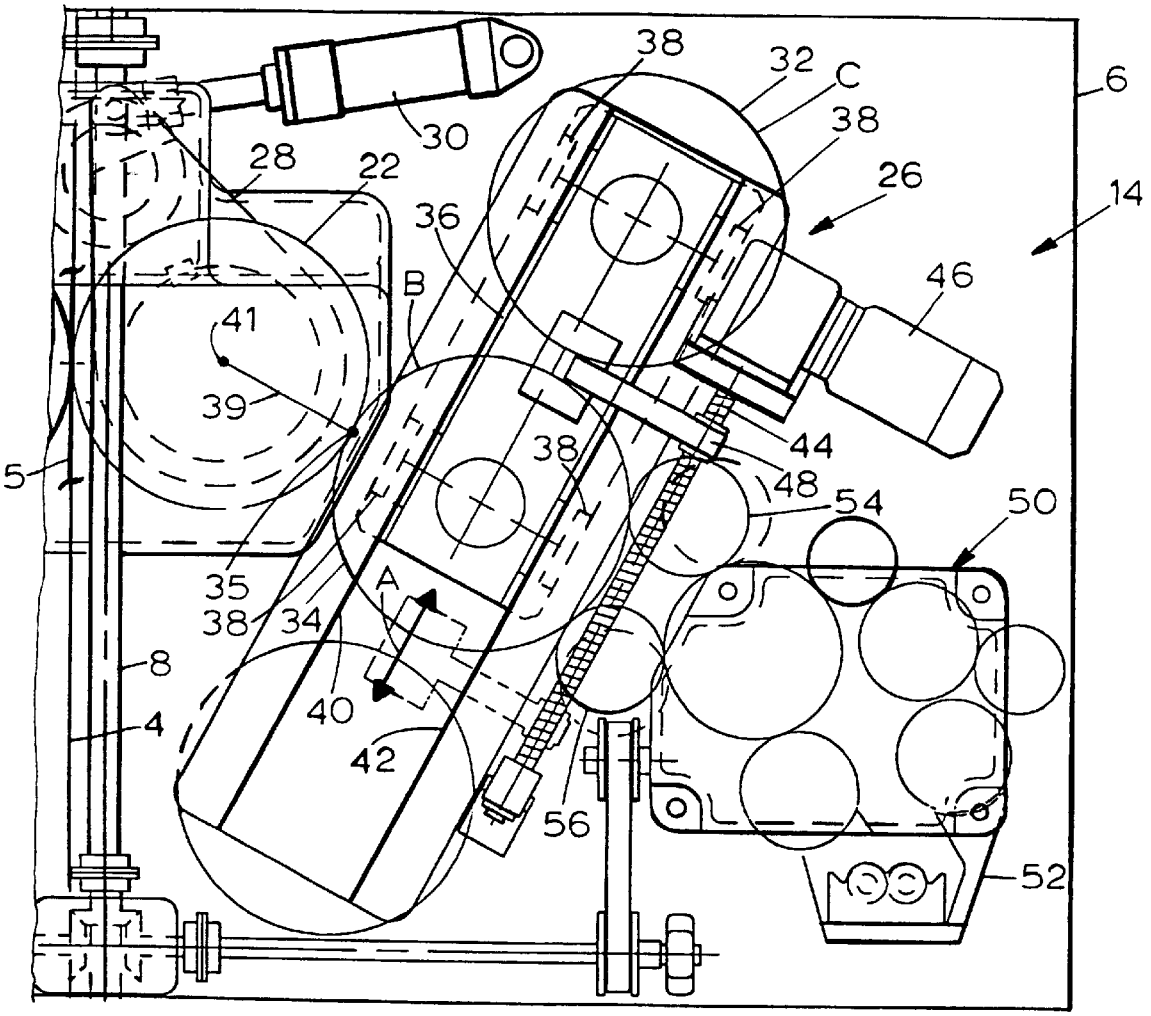
FIG. 2 is an enlarged fragmentary elevational view of the printing press shown in FIG. 1 and illustrating one of the plate cylinders in the middle or operative position in contact with the blanket cylinder.

Referring now to FIG. 2, couple 14 includes a pair of blanket cylinders 20, 22 which converge along the substrate path 4 such that the substrate 5 passes between the blanket cylinders 20, 22, thereby imparting an image to both sides of the substrate 5. Each of the blanket cylinders 20, 22 has associated therewith a plate cylinder assembly 24, 26, respectively. Each plate cylinder assembly 24, 26 in turn includes a pair of plate cylinders 28, 30 and 32, 34, respectively. The diameters of blanket cylinders 20, 22 and plate cylinders 28, 30, 32 and 34 are all identical.

It will be understood that the structure, function and operation of blanket cylinder 20 and its associated plate cylinder assembly 24 is the same as the structure, function and operation of blanket cylinder 22 and its associated plate cylinder assembly 26. Accordingly, only the blanket cylinder 22 and its associated plate cylinder assembly 26, which is shown to the right of FIG. 1, will be described in detail.

Blanket cylinder 22 is rotatably mounted to frame 6 on a set of bearings or sleeves (not shown) in a well known manner. As shown in FIG. 2, cylinder 22 is mounted on an eccentric shaft (not shown) which includes a lever arm 28, and an actuator 30 connects lever arm 28 to frame 6, which permits cylinder 22 to be drawn away from the substrate path 4 and cylinder 20 in order to permit the removal of the substrate 5 in the event of a tear. Blanket cylinder 22 is operatively connected to drive system 8 for rotating cylinder 22.

Plate cylinders 32, 34 of plate cylinder assembly 26 are mounted to a slide assembly or carriage 36 and supported for axial rotation on a set of sleeves or bearings (not shown) in a well known manner. Carriage 36 is slidably mounted to frame 6 by a plurality of linear bearings 38 slidably supported on a pair of tracks or rails 40, 42. A rotatable threaded shaft 44 and a drive motor 46 are mounted to frame 6 adjacent track 42, and an arm 48 extending from carriage 36 and having a threaded follower 49 attached thereto engages rod 44. Accordingly, rotation of rod 44 upon the actuation of drive motor 46 causes carriage 36 to reciprocate back and forth along tracks 40, 42 in a generally linear path as indicated by the reference arrow A between the position shown in FIGS. 2 and 3 and the position shown in FIG. 4. Plate cylinders 32 and 34 move in unison by virtue of their attachment to carriage 36. As such, one of the plate cylinders 32, 34 may be selectively brought into contact with the blanket cylinder 22 depending on the location of carriage 36 along path A.

For example, FIG. 2 illustrates plate cylinder 34 in the middle or operative position designated by reference arrow B in contact with blanket cylinder 22 at a point of contact or tangency 35. It will be noted that point of tangency 35 intersects a radius 39 extending from the axis 41 of blanket cylinder 22. It will also be noted that radius 39 lies generally perpendicular to the path A of carriage 36. With carriage 36 in the position shown, plate cylinder 32 is in its inoperative position designated by reference arrow C located towards one end of path A, which is towards the upper right when viewing FIG. 2, and is more than one cylinder diameter removed from the middle or operative position occupied by plate cylinder 34.

Figure 3:
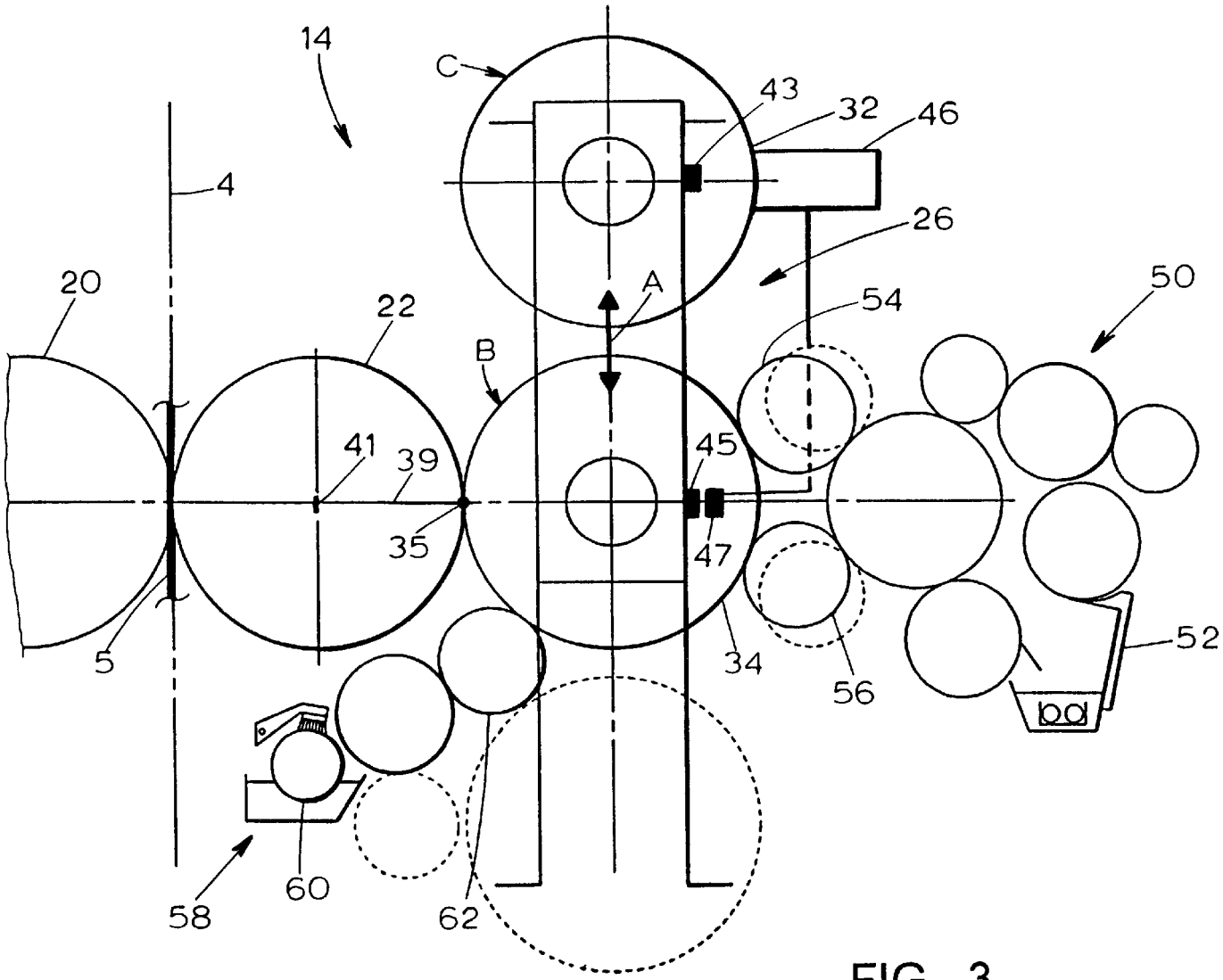
FIG. 3 is a schematic diagram of one of the paired plate cylinder assemblies shown in FIGS. 1 and 2 illustrating the linear movement of the carriage mounted plate cylinders and the movement of the retractable inking rollers.
Figure 4:
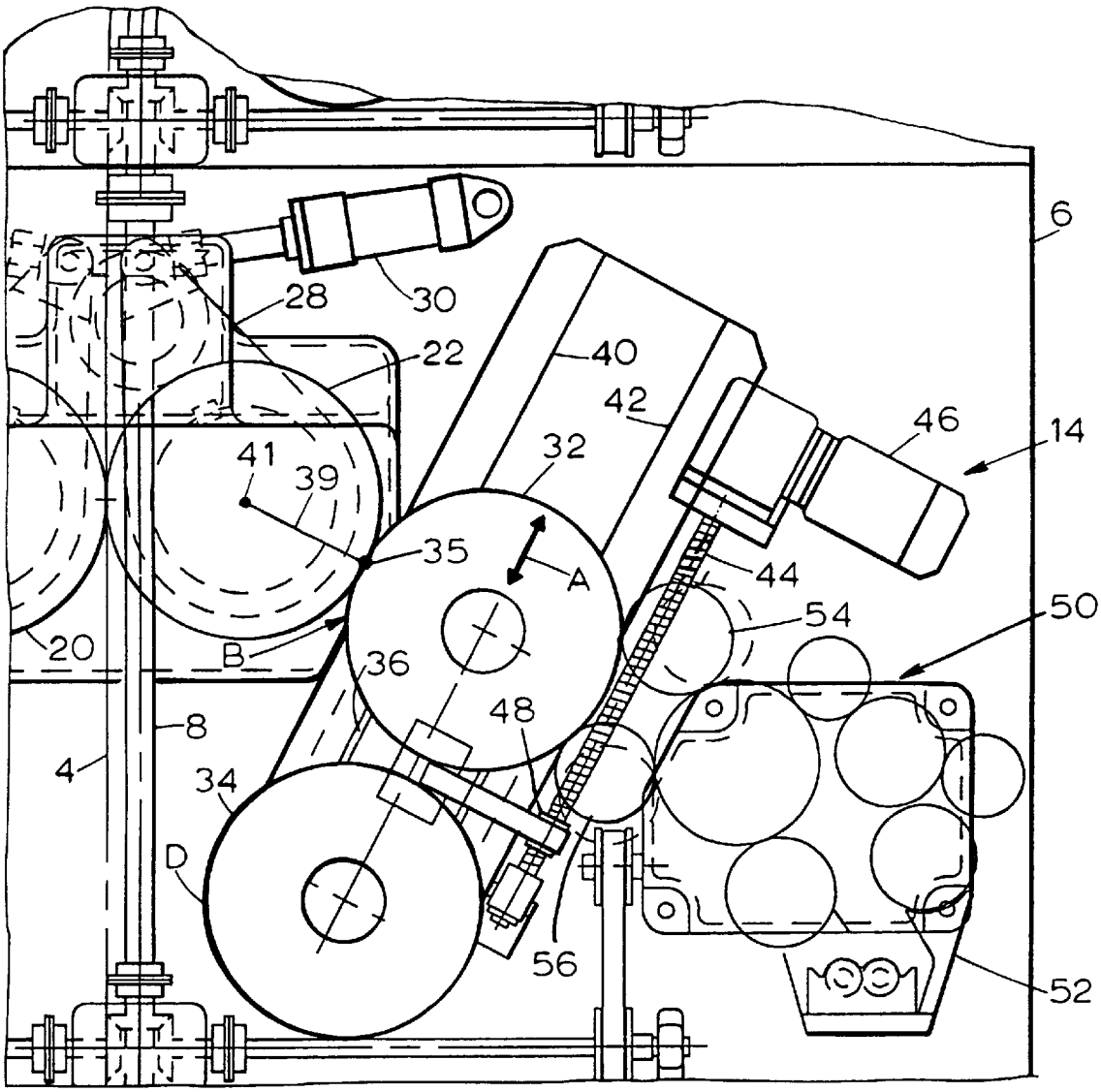
FIG. 4 is an enlarged fragmentary elevational view similar to that shown in FIG. 2, but illustrating the other of the plate cylinders in the operative position.

By comparison, FIG. 4 illustrates the carriage 36 at the other end of path A, with plate cylinder 32 in the operative position in contact with blanket cylinder 22 at the point of tangency 35. Plate cylinder 34 is now in its inoperative position designated by reference arrow D located at the other end of path A, which is towards the lower left when viewing FIG. 4, and is likewise more than one cylinder diameter removed from the middle or operative position B now occupied by plate cylinder 32. As shown schematically in FIG. 3, carriage 36 preferably includes a pair of position sensors 43, 45. A limit switch 47 is operatively connected to drive motor 46. As such, position sensor 43 indicates the presence of plate cylinder 32 in the operative position B, while position sensor 45 indicates the presence of plate cylinder 34 in the operative position B. When either position sensor 43, 45 approaches limit switch 47, the limit switch 47 signals drive motor 46 to stop with carriage 36 at a predetermined location in order to optimize the contact between plate cylinder 32 (FIG. 4) or plate cylinder 34 (FIG. 2) and the adjacent blanket cylinder 22.

As shown in FIGS. 2 through 4, and ink roller assembly 50 is mounted to frame 6 adjacent plate cylinder assembly 26, which transfers ink from an ink supply 52 to either of plate cylinders 32, 34 via a pair of retractable rollers 54, 56. Retractable rollers 54, 56 are shiftable between the extended position as shown by the solid lines in FIGS. 2 through 4, and the retracted position as shown by the dotted lines in FIGS. 2 through 4. When in the extended position the retractable rollers 54, 56 contact either plate cylinder 34 as shown in FIGS. 2 and 3, or plate cylinder 32 as shown in FIG. 4. When in the retracted position, plate cylinder assembly 26 is free to shift between the position shown in FIG. 2 in which plate cylinder 34 abuts blanket cylinder 22, and the position shown in FIG. 4, in which plate cylinder 32 abuts blanket cylinder 22. Retractable rollers 54, 56 are preferably mounted to frame 6 using eccentric shafts (not shown) in a manner well known in the art.

A dampening assembly 58 is also mounted adjacent plate cylinder assembly 26 as shown in FIG. 3. Dampening assembly 58 applies a dampening solution from a supply source 60 to either of the plate cylinders 32, 34 via a retractable dampening roller 62. As shown in FIG. 3, dampening roller 62 is shiftable between the extended position shown in solid lines in FIG. 3 and a retracted position illustrated in dotted lines.

In operation, the four printing couples 12, 14, 16 and 18 are arranged in progression as shown in FIG. 1 such that the continuous substrate 5 running along substrate path 4 will pass between the blanket cylinders of each printing couple, including the blanket cylinders 20, 22 of printing couple 14. All of the cylinders in the system are rotated at a common peripheral speed by drive system 8 in a manner well known in the art. As shown in FIGS. 1 through 3, printing couple 14 during normal operations is positioned such that blanket cylinder 22 abuts blanket cylinder 20 such that the cylinders impart an image on each of the opposite sides of the substrate 5 passing between the blanket cylinders along substrate path 4. When the plate cylinder assembly 26 is in the position shown in FIGS. 1 and 2, plate cylinder 34 abuts blanket cylinder 22, thus transferring images from plate cylinder 34 to blanket cylinder 22 for subsequent transference to the substrate 5 in a manner well known in the art. When it is desired to change editions or shift to a different print run, the retractable ink rollers 54 and 56 are retracted to the positions illustrated by the dotted lines in FIG. 3, and the retractable dampening roller 62 is likewise retracted to the position illustrated by the dotted lines in FIG. 3. With the rollers 54, 56 and 62 retracted, carriage 36 is free to move in the linear direction as indicated by reference arrow A in FIG. 2 upon the rotation of threaded rod 44 by drive motor 46. After the plate cylinder assembly 26 has been shifted to the position shown in FIG. 4, the retractable rollers 54, 56 and 62 are returned to their contact positions abutting plate cylinder 32, and plate cylinder 32 in turn abuts blanket cylinder 22. The press 10 can now be operated using plate cylinder 32 in place of plate cylinder 34, with plate cylinder 34 now being idle and spaced away from blanket cylinder 22. Furthermore, the surface of plate cylinder 34 can now be prepared for the next print job, which is typically accomplished by removing an impression sleeve (not shown) from the plate cylinder in a conventional manner. Meanwhile, the press 10 can be operated while the impression sleeve on plate cylinder 34 is being changed. Subsequently, when it is again desired to change the edition being printed or to start an entirely new job, the plate cylinder assembly 26 is again shifted back into the position shown in FIGS. 1 through 3, and the press is operated using the plate cylinder 34. In this position, the impression sleeve on the surface of plate cylinder 32 can now be changed while the press 10 is operating using plate cylinder 34.

It will be understood that the above description does not limit the invention to the above-given details. It is contemplated that various modifications and substitutions can be made without departing from the spirit and scope of the following claims.

What is claimed:

1. A printing press comprising:

a frame;

a blanket cylinder rotatably supported by said frame, said blanket cylinder being positioned for contacting and transferring images to a web of paper passing through the press;

a carriage slidably mounted to said frame and being moveable along a path between a first position and a second position;

first and second plate cylinders rotatably mounted to said carriage, said plate cylinders being parallel to said blanket cylinder and being adapted to transfer images to said blanket cylinder, said first plate cylinder being in contact with said blanket cylinder at a point of tangency when said carriage is in said first position and said second plate cylinder being in contact with said blanket cylinder at said point of tangency when said carriage is in said second position.

2. The device as claimed in claim 1, wherein said carriage path is linear, said path being generally perpendicular to a radius extending from the axis of said blanket cylinder through said point of tangency.

3. The device as claimed in claim 1, wherein said carriage is slidably mounted to said frame by linear bearings.

4. The device as claimed in claim 1, including an axially rotatable threaded rod mounted to said frame, said rod being disposed generally parallel to said carriage path, said carriage including a thread follower engaging said rod, whereby said carriage is moved along said path in response to rotation of said rod.

5. The device as claimed in claim 4, including a reversible drive motor engaging said rod for rotating said rod.

6. The device as claimed in claim 5, including a position sensor operatively connected to said carriage for sensing the position of said carriage relative to said frame, and further including a limit switch carried by said motor and operatively connected to said position sensor.

7. The device as claimed in claim 1, including an inking roller rotatably mounted to said frame for applying ink to one of said plate cylinders when said one plate cylinder is in contact with said blanket cylinder, said inking roller being shiftable between a contact position in contact with said one plate cylinders when said one plate cylinder is in contact with said blanket cylinder and a retracted position.

8. The device as claimed in claim 1, including an actuator engaging said carriage for moving said carriage along said path.

9. The device as claimed in claim 1, wherein said blanket cylinder and said plate cylinders have the same diameter, and further wherein said carriage is adapted to move along said path a distance greater than said diameter.

10. The device as claimed in claim 1, wherein said path is generally linear and includes a path mid-portion and a pair of path ends, each of said plate cylinders being selectively movable to an operable position defined by said path mid-portion, one of said plate cylinders further being moveable to an inoperable position defined by one of said path ends and the other of said plate cylinder being moveable to an inoperable position defined by the other of said path ends.

11. The device as claimed in claim 10, wherein said blanket cylinder and said plate cylinders have the same diameter, and further wherein said carriage is adapted to move along said path a distance greater than said diameter.

12. A printing press comprising:

a frame;

a blanket cylinder rotatably supported by said frame, said blanket cylinder being positioned for contacting and transferring images to a web of paper passing through the press;

a pair of plate cylinders rotatably mounted to a carriage, said carriage being mounted to said frame and being moveable along a linear path between a first and second position, one of said plate cylinders being in contact with said blanket cylinder at a point of tangency when said carriage is in said first position, the other of said plate cylinders being in contact with said blanket cylinder at the same said point of tangency when said carriage is in said second position.

13. The device as claimed in claim 12, wherein said path is generally perpendicular to a radius extending from the axis of said blanket cylinder through said point of tangency.

14. The device as claimed in claim 12, wherein said carriage is slidably mounted to said frame by linear bearings.

15. The device as claimed in claim 12, including an axially rotatable threaded rod mounted to said frame, said rod being disposed generally parallel to said linear path, said carriage including a thread follower engaging said rod, whereby said carriage is moved along said path in response to rotation of said rod.

16. The device as claimed in claim 15, including a reversible drive motor engaging said rod for rotating said rod.

17. The device as claimed in claim 16, including a position sensor operatively connected to said carriage for sensing the position of said carriage relative to said frame, and further including a limit switch carried by said motor and operatively connected to said position sensor.

18. The device as claimed in claim 13, including an inking roller rotatably mounted to said frame for applying ink to one of said plate cylinders when said one plate cylinder is in contact with said blanket cylinder, said inking roller being shiftable between a contact position in contact with said one plate cylinders when said one plate cylinder is in contact with said blanket cylinder and a retracted position.

19. The device as claimed in claim 13, including an actuator engaging said carriage for moving said carriage along said path.

20. The device as claimed in claim 13, wherein said blanket cylinder and said plate cylinders have the same diameter, and further wherein said carriage is adapted to move along said path a distance greater than said diameter.

21. The device as claimed in claim 13, wherein said path is generally linear and includes a path mid-portion and a pair of path ends, each of said plate cylinders being selectively movable to an operable position defined by said path mid-portion, one of said plate cylinders further being moveable to an inoperable position defined by one of said path ends and the other of said plate cylinders being moveable to an inoperable position defined by the other of said path ends.

22. The device as claimed in claim 21, wherein said blanket cylinder and said plate cylinders have the same diameter, and further wherein said carriage is adapted to move along said path a distance greater than said diameter.

23. A printing press comprising:

a frame;

a blanket cylinder rotatably supported by said frame, said blanket cylinder being positioned for contacting and transferring images to a carrier material;

a pair of rotatable plate cylinders adapted to transfer images to said blanket cylinder, said plate cylinders being slidably mounted to said frame and being moveable along a linear path, each of said plate cylinders being selectively moveable into a common operative position parallel to and in contact with said blanket cylinder.

24. The device as claimed in claim 23, wherein said plate cylinders move along said path in unison.

25. The device as claimed in claim 24, wherein said plate cylinders are mounted to a carriage, said carriage being slidably mounted to said frame.

26. The device as claimed in claim 23, wherein said linear path includes opposite ends, each of said opposite ends defining an inoperative position for one of said plate cylinders, said inoperative positions being spaced away from said blanket cylinder.

27. The device as claimed in claim 23, including a linear actuator engaging said plate cylinders for moving said plate cylinders along said path.

* * * * *

UNITED STATES PATENT AND TRADEMARK OFFICE

CERTIFICATE OF CORRECTION

PATENT NO. : 5,806,427

DATED : September 15, 1998

INVENTOR(S) : Niemiro et al.

It is certified that error appears in the above-identified patent and that said Letters Patent is hereby corrected as shown below:

Column 3, line 10, between "18" and "are" please insert --that--.

Signed and Sealed this

Ninth Day of February, 1999

*Attest:*

*Acting Commissioner of Patents and Trademarks*

*Attesting Officer*